US012642418B2

(12) United States Patent
Del Pos et al.

(10) Patent No.: US 12,642,418 B2
(45) Date of Patent: Jun. 2, 2026

(54) DISHWASHER INCLUDING A FLOW CONTROLLER ASSEMBLY

(71) Applicant: ELECTROLUX APPLIANCES AKTIEBOLAG, Stockholm (SE)

(72) Inventors: Maurizio Del Pos, Porcia (IT); Nicola Reid, Porcia (IT); Alberto Santarossa, Porcia (IT); Luca Guiotto, Porcia (IT)

(73) Assignee: ELECTROLUX APPLIANCES AKTIEBOLAG, Stockholm (SE)

( * ) Notice: Subject to any disclaimer, the term of this patent is extended or adjusted under 35 U.S.C. 154(b) by 240 days.

(21) Appl. No.: 18/717,290

(22) PCT Filed: Dec. 15, 2021

(86) PCT No.: PCT/EP2021/085909
§ 371 (c)(1),
(2) Date: Jun. 6, 2024

(87) PCT Pub. No.: WO2023/110079
PCT Pub. Date: Jun. 22, 2023

(65) Prior Publication Data
US 2025/0040782 A1 Feb. 6, 2025

(51) Int. Cl.
*A47L 15/42* (2006.01)

(52) U.S. Cl.
CPC ..... *A47L 15/4221* (2013.01); *A47L 15/4225* (2013.01); *A47L 15/4246* (2013.01)

(58) Field of Classification Search
None
See application file for complete search history.

(56) References Cited

U.S. PATENT DOCUMENTS

| | | | |
|---|---|---|---|
| 9,743,822 | B2 | 8/2017 | Boyer et al. |
| 2014/0182625 | A1 | 7/2014 | Lee |
| 2017/0071444 | A1 | 3/2017 | Hofmann |

FOREIGN PATENT DOCUMENTS

| | | |
|---|---|---|
| EP | 3750469 | 12/2020 |
| WO | 2009068385 | 6/2009 |

OTHER PUBLICATIONS

Sabatucci, Arianna International Search Report and Written Opinion—International Application No. PCT/EP2021/085909, European patent office; Aug. 3, 2022; pp. 1-18.

*Primary Examiner* — Levon J Shahinian
(74) *Attorney, Agent, or Firm* — Chrisman Gallo Tochtrop LLC

(57) ABSTRACT

A dishwasher including: a washing fluid conduit system including a first washing fluid supply conduit terminating at an outlet, a second washing fluid supply conduit terminating at an outlet, and a third washing fluid supply conduit terminating at an outlet; a sump including a plate comprising (i) a first outlet for a first spray device of the washing fluid conduit system, (ii) a second outlet for a second spray device of the washing fluid conduit system, and (iii) a third outlet for a third spray device of the washing fluid conduit system; a pump for pumping washing fluid from the sump to the washing fluid conduit system; and a flow controller assembly for controlling washing fluid flow from the sump to the washing fluid conduit system, the flow controller assembly including: a disk comprising at least (i) a first aperture, (ii) a second aperture, and (iii) a fourth aperture; and a positioning device configured to: rotate the disk to align the first aperture of the disk with the first outlet and second outlet of the plate and the second aperture of the disk with the third outlet of the plate; supply, through the first, second, and third outlets of the plate, a washing fluid to the first, second, and third spray devices; rotate the disk to align the first aperture (Continued)

and the fourth aperture of the disk with the second and third outlets respectively of the plate; supply, through the second and third outlets of the plate, the washing fluid to the second and third spray devices; rotate the disk to align the first aperture of the disk with the first outlet of the plate; and supply, through the first outlet of the plate, the washing fluid to the first spray device.

20 Claims, 14 Drawing Sheets

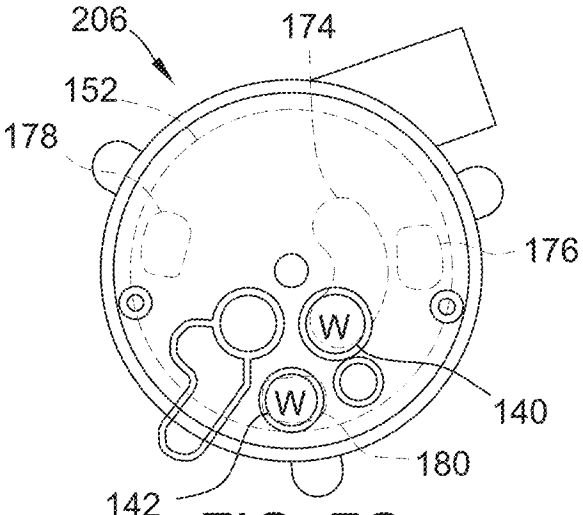
FIG. 7A
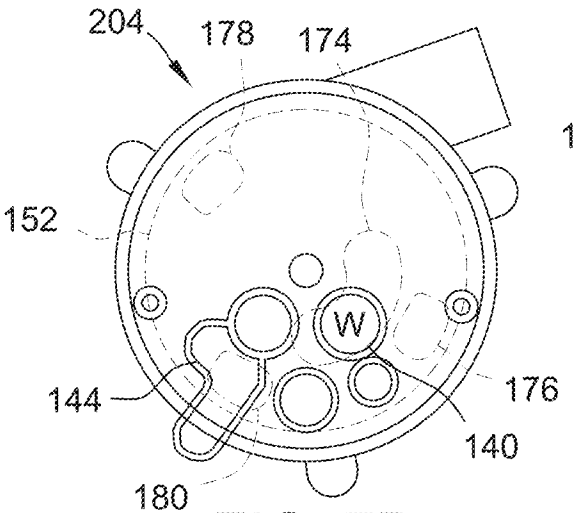
FIG. 7B
FIG. 7C
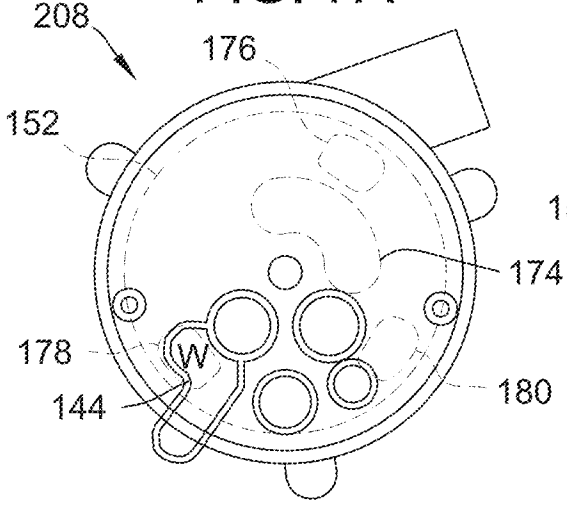
FIG. 7D
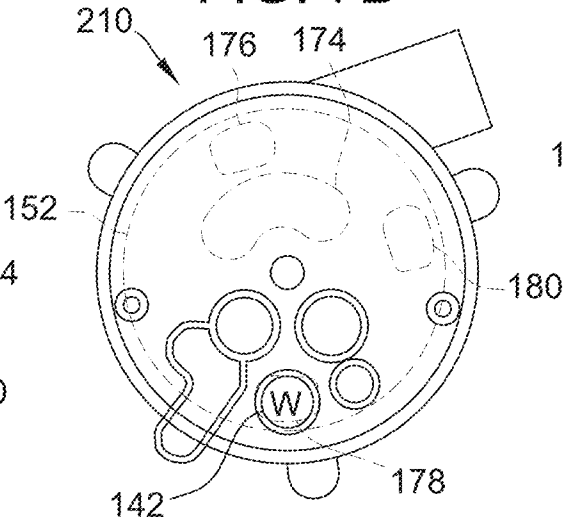
FIG. 7E
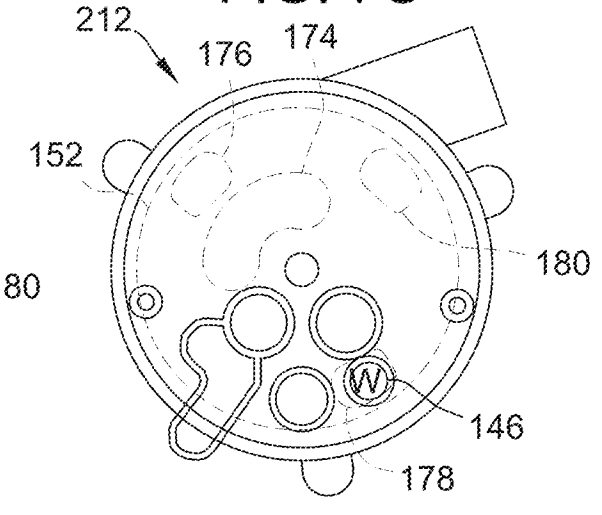
FIG. 7F

DISHWASHER INCLUDING A FLOW CONTROLLER ASSEMBLY

CROSS-REFERENCE TO RELATED APPLICATIONS

This application is a national stage under 35 U.S.C. § 371 of International Application No. PCT/EP2021/085909, filed Dec. 15, 2021, the entire disclosure of which is incorporated by reference herein.

FIELD OF THE DISCLOSURE

The present disclosure relates to a dishwasher, and more particularly, to a flow controller assembly for controlling water flow from a sump of the dishwasher to a water conduit system of the dishwasher.

BACKGROUND OF THE DISCLOSURE

In dishwashers, flow controllers may be used to direct water fluid from a sump to a water supply conduit system. The flow controllers are utilized to supply water to the interior of the dishwasher in a manner consistent with the selected dishwasher cleaning cycle to suitably clean the dishes, utensils, pots, pans and any other items placed in the dishwasher for cleaning. These flow controllers are typically located proximate the dishwasher sump.

In the case of known flow controller disclosed in published U.S. Patent Application with Publication No. 2014/0182625 a dishwasher flow controller is movable between two positions to selectively control the flow of wash water within a dishwasher. The first position enables the supply of wash water to wash arms located in a single, fixed position in the dishwasher housing of the dishwasher. The second position actuates a drain pump to store recycled wash water.

In another known flow controller disclosed in U.S. Pat. No. 9,980,624, a variable position diverter that provides wash fluid to selected combinations of outlets ports and spray assemblies is disclosed. The diverter includes a valve that can be selectively switched between the two outlet ports to selectively place a pump in fluid communication with spray assemblies through apertures of a disk. The first outlet port is fluidly connected with both the upper and lower spray assemblies, and the second outlet port is fluidly connected with the middle spray assembly. Accordingly, when the diverter is fluidly connected with the first outlet port, both the upper and lower spray assemblies must have wash fluid supplied to them, and a separate outlet port for each spray assembly is not provided. Similarly, published U.S. Patent Application with Publication No. 2004/0226586 discloses a diverter that selectively supplies wash fluid to two outlet ports of a dishwasher.

In another known flow controller disclosed in U.S. Pat. No. 10,638,910, a diverter configured to supply liquid to components of a dishwasher is provided. The diverter selectively directs liquid to a spraying system and a filter of the dishwasher such that a varying amount of wash liquid is filtered during a cycle of the dishwasher.

In another known flow controller disclosed in Chinese Patent No. 210643953, a water diversion device of a dishwasher is provided. The cover plate of the water diversion device has three water outlet holes, each hole connected to a different spray arm of the dishwasher, and a water diversion piece rotates relative to the cover plate to ensure that one or two water through holes are overlapped with the water outlet holes to provide water to the spray arms.

Notably, at least one water outlet hole is covered during each dishwashing cycle. Similarly, published International Patent Application with publication No. WO2019/101103 also describes a water diversion device with only three water outlet holes.

In another known flow controller disclosed in U.S. Pat. No. 8,915,257, a water diverter and rotating disk of a dishwasher are provided. The water diverter includes three discharge pipes, each connected to one of three spray arms of the dishwasher, and the rotating disk includes seven passage openings. The disk is rotated relative to the water diverter to one of six different rotation positions such that different configurations of the discharge pipes are supplied washing liquid. No rotation configuration supplies washing liquid to all of the three spray arms at the same time.

SUMMARY OF THE DISCLOSURE

The present invention relates to a dishwasher comprising: a washing fluid conduit system comprising a first washing fluid supply conduit terminating at an outlet, a second washing fluid supply conduit terminating at an outlet, and a third washing fluid supply conduit terminating at an outlet; a sump comprising a plate comprising (i) a first outlet for a first spray device of the washing fluid conduit system. (ii) a second outlet for a second spray device of the washing fluid conduit system, and (iii) a third outlet for a third spray device of the washing fluid conduit system; a pump for pumping washing fluid from the sump to the washing fluid conduit system; and a flow controller assembly for controlling washing fluid flow from the sump to the washing fluid conduit system, the flow controller assembly comprising: a disk comprising at least (i) a first aperture, (ii) a second aperture, and (iii) a fourth aperture; and a positioning device configured to: rotate the disk to align the first aperture of the disk with the first outlet and second outlet of the plate and the second aperture of the disk with the third outlet of the plate; supply, through the first, second, and third outlets of the plate, a washing fluid to the first, second, and third spray devices; rotate the disk to align the first aperture and the fourth aperture of the disk with the second and third outlets respectively of the plate; supply, through the second and third outlets of the plate, the washing fluid to the second and third spray devices; rotate the disk to align the first aperture of the disk with the first outlet of the plate; and supply, through the first outlet of the plate, the washing fluid to the first spray device.

The above solution enables an improved washing flexibility since it is possible to perform a quick washing cycle in which all the lower, middle and top spray arm are active at the same time and an eco cycle in which lower and top are active at the same time, whereas the middle spray arm is active when lower and top are not in operation. The eco cycle allows water saving with a specific alternative washing action that guarantees improved washing performance Preferably, the positioning device is further configured to: rotate the disk to align the first aperture of the disk with the second outlet of the plate; supply, through the second outlet of the plate, the washing fluid to the second spray device. This provides the possibility to operate only the top spray device to further improve the washing flexibility with the target to use washing liquid only where it is needed.

Preferably the disk comprising at least a third aperture, and wherein the positioning device is further configured to: rotate the disk to align the third aperture of the disk with the third outlet of the plate: supply, through the third outlet, the washing fluid to the third spray device. This provides the possibility to operate only the lower spray device to further improve the washing flexibility with the target to use washing liquid only where it is needed.

Preferably the sump further comprises at least a first extra outlet, and the disk comprising at least a third aperture, wherein the positioning device is further configured to: rotate the disk to align the third aperture of the disk with the first extra outlet of the plate; and supply, through first extra outlet of the plate, the washing fluid to an additional device of the washing fluid conduit system. This enables a further functionality of the dishwasher other than to supply washing liquid to the lower, middle and top spray devices.

Preferably the plate further comprises a second extra outlet, and wherein the positioning device is further configured to: rotate the disk to align the third aperture of the disk with the second extra outlet of the plate; and supply, through first extra outlet of the plate, the washing fluid to an additional device of the washing fluid conduit system. This enables an even further functionality of the dishwasher other than to supply washing liquid to the lower, middle and top spray devices. The same third aperture of the disk to activate both the first and second extra outlet of the plate. This allows a compact configuration of the disk.

Preferably the plate comprising a periphery, the plate further comprising: a first outlet region comprising (i) the first outlet for supplying washing fluid to the first washing fluid supply conduit and (ii) the second outlet for supplying washing fluid to the second washing fluid supply conduit; and a second outlet region comprising (i) the third outlet for supplying washing fluid to the third washing fluid supply conduit, wherein the first and second outlet regions are arranged at different locations on the plate. This allow a compact configuration of the sump and a better interaction with the flow controller.

Preferably the second outlet region comprising (i) at least one extra outlet. This provides a further outlet for extra functionalities in addition to supply washing liquid to the lower, middle and top spray device and still maintaining a compact configuration of the plate and flow controller.

Preferably the disk comprising: a first annular region comprising the first aperture; and a second annular region comprising at least the second aperture and the fourth aperture, wherein the first and second annular regions are separated by a distance on the disk. This configuration provides a plurality of apertures to match the outlets of the plate by maintaining a compact design of the disk and hence of the flow controller.

Preferably the second annular region further comprises the third aperture. This configuration provides a plurality of apertures to match the outlets of the plate by maintaining a compact design of the disk and hence of the flow controller.

Preferably the first washing fluid supply conduit is located between the second and third washing fluid supply conduit and the first spray device is located between the second and third spray devices. Preferably the dishwasher has a top and bottom, and wherein the second washing fluid supply conduit is located proximate the top of the dishwasher, the third washing fluid supply conduit is located proximate the dishwasher bottom and the first washing fluid supply conduit is located between the second and third washing fluid supply conduits.

Preferably the plate is disk-shaped and includes a peripheral portion, wherein the second outlet region is located proximate the peripheral portion and the first outlet region is located a radial distance from the peripheral portion. This allow a compact configuration of the sump and a better interaction with the flow controller.

Preferably the positioning device is further configured to: rotate the disk to align the first aperture of the disk with the first outlet of the plate and the second aperture of the disk with a first extra outlet of the plate; supply, through the first outlet, the washing fluid to the first spray device; and supply, through the first extra outlet of the plate, the washing the washing fluid to an additional device of the washing fluid conduit system. This provides for an additional functionality to be operated when the middle spray art is active to improve flexibility.

Preferably the additional device of the washing fluid conduit system comprising at least one of (i) an extra spray device of the washing fluid conduit system, (ii) a detergent dispenser, (iii) a tank arranged outside of the sump, (iv) a filter to be automatically cleaned by the washing fluid, and (v) a heat exchanger of the washing fluid conduit system.

Another aspect of the present invention relates to a dishwasher comprising: a washing fluid conduit system comprising a first washing fluid supply conduit terminating at an outlet, a second washing fluid supply conduit terminating at an outlet, and a third washing fluid supply conduit terminating at an outlet; a sump comprising a plate comprising (i) a first outlet for a first spray device of the washing fluid conduit system, (ii) a second outlet for a second spray device of the washing fluid conduit system, and (iii) a third outlet for a third spray device of the washing fluid conduit system; a pump for pumping washing fluid from the sump to the washing fluid conduit system; and a flow controller assembly for controlling washing fluid flow from the sump to the washing fluid conduit system, the flow controller assembly comprising: a disk comprising at least (i) a first aperture, (ii) a second aperture, and (iii) a third aperture; and a positioning device configured to: rotate the disk to align the first aperture of the disk with the first outlet and second outlet of the plate and the second aperture of the disk with the third outlet of the plate; supply, through the first, second, and third outlets of the plate, a washing fluid to the first, second, and third spray devices: rotate the disk to align the first aperture of the disk with the first outlet of the plate; and supply, through the first outlet of the plate, the washing fluid to the first spray device; rotate the disk to align the first aperture of the disk with the second outlet of the plate; and supply, through the second outlet of the plate, the washing fluid to the second spray device: rotate the disk to align the third aperture of the disk with the third outlet of the plate; and supply, through the third outlet, the washing fluid to the third spray device.

The above solution enables an improved washing flexibility since it is possible to perform a quick washing cycle in which all the lower, middle and top spray arm are active at the same time and eco cycles in which only the lower, or the middle or top are active according to the need. The eco cycles allows water saving with specific alternative washing actions that guarantee improved washing performance.

Preferably the disk further comprising a fourth aperture and wherein the positioning device is further configured to: rotate the disk to align the first aperture and the fourth aperture of the disk with the second and third outlets respectively of the plate; supply, through the second and third outlets of the plate, the washing fluid to the second and third spray devices. This further improves the flexibility of the system since an eco cycle in which lower and top are active at the same time while the middle spray arm is inactive.

Preferably the plate further comprises at least a first extra outlet, and wherein the positioning device is further configured to: rotate the disk to align the third aperture of the disk with the first extra outlet of the plate; and supply, through first extra outlet of the plate, the washing fluid to an additional device of the washing fluid conduit system. This enables a further functionality of the dishwasher in addition to supply washing liquid to the lower, middle and top spray devices Preferably the plate further comprises a second extra outlet, and wherein the positioning device is further configured to: rotate the disk to align the third aperture of the disk with the second extra outlet of the plate; and supply, through first extra outlet of the plate, the washing fluid to an additional device of the washing fluid conduit system. This enables an even further functionality of the dishwasher in addition to supply washing liquid to the lower, middle and top spray devices. The same third aperture of the disk to activate both the first and second extra outlet of the plate. This allows a compact configuration of the disk.

Preferably the plate comprising a periphery, the plate further comprising: a first outlet region comprising (i) the first outlet for supplying washing fluid to the first washing fluid supply conduit and (ii) the second outlet for supplying washing fluid to the second washing fluid supply conduit and a second outlet region comprising (i) the third outlet for supplying washing fluid to the third washing fluid supply conduit, wherein the first and second outlet regions are arranged at different locations on the plate. This allow a compact configuration of the sump and a better interaction with the flow controller.

Preferably the second outlet region comprising (i) at least one extra outlet. This provides a further outlet for extra functionalities in addition to supply washing liquid to the lower, middle and top spray device and still maintaining a compact configuration of the plate and flow controller.

Preferably the disk comprising: a first annular region comprising the first aperture; and a second annular region comprising at least the second aperture and the third aperture, wherein the first and second annular regions are separated by a distance on the disk. This configuration provides a plurality of apertures to match the outlets of the plate by maintaining a compact design of the disk and hence of the flow controller.

Preferably the second annular region comprising the fourth aperture. This configuration provides a plurality of apertures to match the outlets of the plate by maintaining a compact design of the disk and hence of the flow controller.

Preferably the first washing fluid supply conduit is located between the second and third washing fluid supply conduit, and the first spray device is located between the second and third spray devices. Preferably the dishwasher has a top and bottom, and wherein the second washing fluid supply conduit is located proximate the top of the dishwasher, the third washing fluid supply conduit is located proximate the dishwasher bottom and the first washing fluid supply conduit is located between the second and third washing fluid supply conduits.

Preferably the plate is disk-shaped and includes a peripheral portion, wherein the second outlet region is located proximate the peripheral portion and the first outlet region is located a radial distance from the peripheral portion. This allow a compact configuration of the sump and a better interaction with the flow controller.

Preferably the positioning device is further configured to: rotate the disk to align the first aperture of the disk with the first outlet of the plate and the second aperture of the disk with a first extra outlet of the plate; supply, through the first outlet, the washing fluid to the first spray device; and supply, through the first extra outlet of the plate, the washing the washing fluid to an additional device of the washing fluid conduit system. This provides for an additional functionality to be operated while the middle spray art is active to improve flexibility.

Preferably the additional device of the washing fluid conduit system comprising at least one of (i) an extra spray device of the washing fluid conduit system, (ii) a detergent dispenser, (iii) a tank arranged outside of the sump, (iv) a filter to be automatically cleaned by the washing fluid, and (v) a heat exchanger of the washing fluid conduit system.

BRIEF DESCRIPTION OF THE DRAWINGS

Preferred embodiments of the disclosure will be further described, by way of non-limiting examples only, with reference to the accompanying drawings in which:

FIGS. 7A-H are top views of potential positions of the flow controller assembly relative to the sump of FIG. 3;

DETAILED DESCRIPTION

The systems and methods described herein are directed to a dishwasher with a flow controller that controls the supply of washing fluid from a sump of the dishwasher to different components of the dishwasher (e.g., a water conduit system, separate tanks, a dish detergent booster, a self-cleaning filter, etc.). The novel flow controller and the sump provided herein overcome the shortcomings associated with known flow controllers in the art by providing washing fluid to the dishwasher in an effective and efficient manner while providing additional functionality to the dishwasher where washing fluid can be supplied to components of the dishwasher other than the water conduit system. Further, used washing fluid can be drained from an interior of the dishwasher through the flow controller, and washing fluid can be provided to separate tanks within the dishwasher through a channel in the sump.

Figure 1:
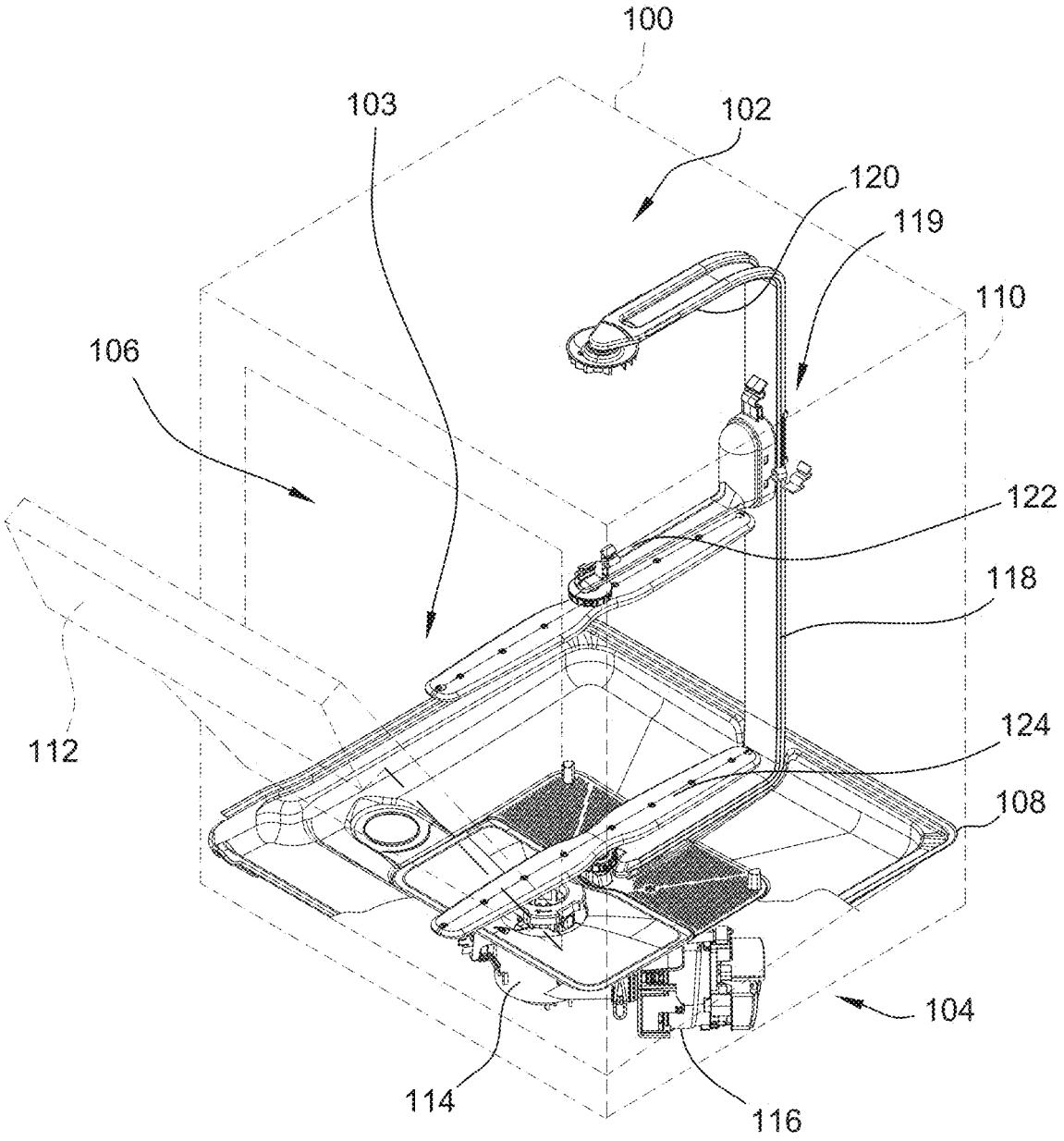
FIG. 1 is a perspective view of a dishwasher device of one embodiment of the disclosure.

FIG. 1 illustrates an example dishwasher 100. The dishwasher 100 has top portion 102, bottom portion 104, and tub 106 that extends between the top and bottom dishwasher portions. The tub, top and bottom portions are represented in dashed font in FIG. 1 The tub and top and bottom portions define chamber 103. Bottom panel 108 (shown as partially broken away in FIG. 1 to show internal detail) is located in the dishwashing chamber proximate bottom portion 104. Tub 106 comprises a plurality of walls 110. Dishes, utensils, and other dishware (also referred to herein as "contents" of the dishwasher 100) may be placed in chamber 103 for cleaning. Dishwasher 100 may also include slidable lower and upper racks (not shown) for holding the contents of the dishwasher. The racks are movable into and out of the chamber. Also represented in dashed font in FIG. 1 is door 112 that may be pivotably connected with the tub 106 to selectively permit access to chamber 103 and seal tub 106 when the dishwasher is operating (e.g., when the contents of the dishwasher 100 are washed and/or cleaned).

Dishwasher 100 includes sump 114 in which washing fluid is collected, typically under the influence of gravity. The washing fluid is used by the dishwasher to clean, wash, and rinse the contents of the dishwasher and may include, for example, any combination of water, fresh waster, softened water, water mixed with detergent, dishwashing soap, and any other suitable washing and/or rinsing fluid. The washing fluid may be pumped by circulation pump 116 through washing fluid conduit system 118. The washing fluid conduit system includes delivery conduit 119 that is flow connected to one or more spray arms. In the exemplary embodiment of the disclosure, the delivery conduit is connected to top spray arm 120, middle spray arm 122, and lower spray arm 124. Top spray arm 120 is proximate top portion 102 of the dishwasher, lower spray arm 124 is proximate the bottom panel 108, and middle spray arm 122 is located between the top and lower spray arms. Delivery conduit 119 and spray arms 120, 122, and 124 of washing fluid delivery system 118 are located in chamber 103, and are configured for spraying the washing fluid, under pressure, onto the contents in chamber 103 during dishwasher use.

The dishwasher may also include controller (not specifically shown) in communication with one or more of the dishwasher's functional components. For example, the controller may be in communication with pump 116 and may be configured to selectively operate the pump 116 to send washing fluid to at least one of spray arms 120, 122, and/or 124 of washing fluid conduit system 118. In accordance with some embodiments, the controller can control a flow controller, as will be described in more detail below. In some embodiments, the controller may include a memory for storage of data such as routines for operation of dishwasher 100. In some embodiments, the controller may be housed in lower portion 104 of dishwasher 1W.

Figure 2:
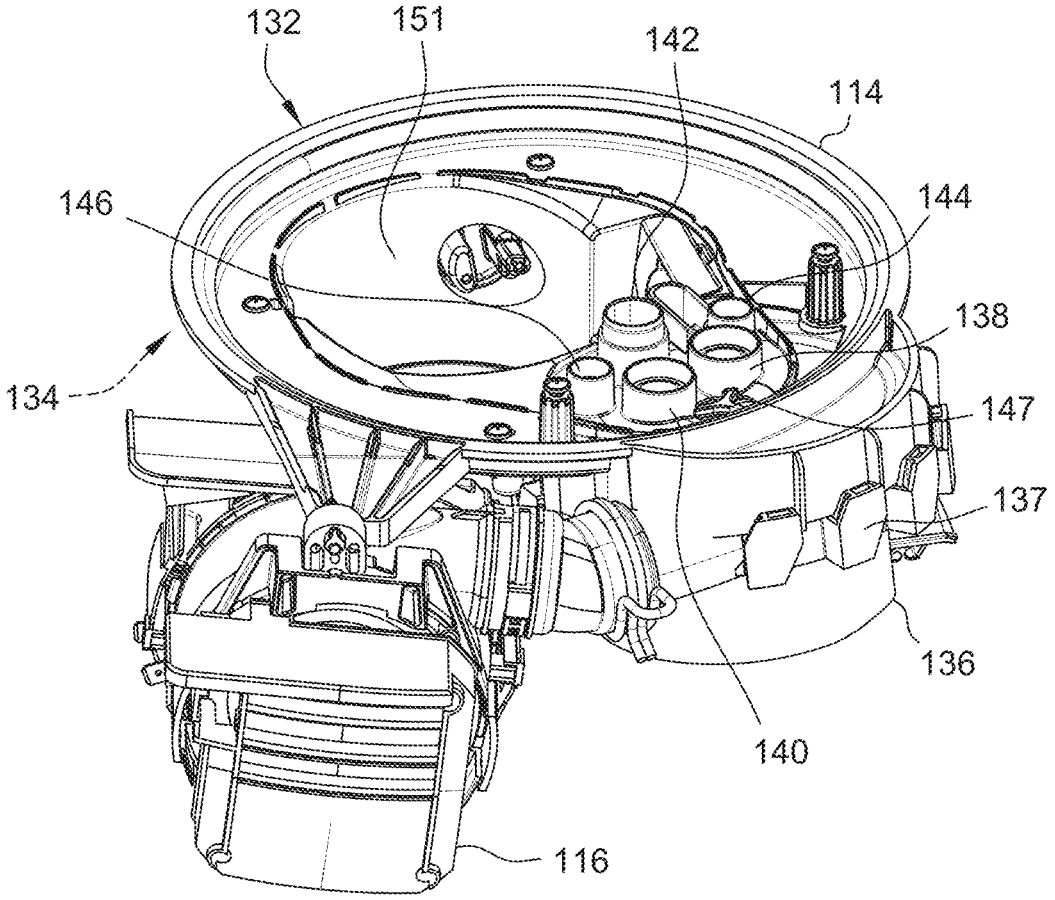
FIG. 2 is a perspective view of a sump and a pump of the dishwasher device of FIG. 1.

FIG. 2 comprises a perspective view of dishwasher sump 114 and pump 116 (shown in FIG. 1). Sump 114 has internal side 132 that, in use, is located proximate bottom panel 108, and further shown in FIG. 1, and external side 134 opposite internal side 132. Housing 136 fluidly connects sump external side 134 to pump 116. The housing comprises an inlet 169 fluidly connected to an outlet of the pump 116. The housing includes the flow controller assembly that will be described in further detail below and is connected to the sump with engagement means 137. A plurality of sump outlets are provided along the internal side of the sump. The outlets generally serve to enable the flow of washing fluid from sump 114 to different components of the dishwasher. The sump 114 includes a plate comprising (i) a first outlet (138) for a first spray device of the washing fluid conduit system. (ii) a second outlet (140) for a second spray device of the washing fluid conduit system (118), and (iii) a third outlet (142) for a third spray device of the washing fluid conduit system.

The plurality of outlets include a first outlet 138, a second outlet 140, a third outlet 142, a first extra outlet 144, and a second extra outlet 146. The outlets 138, 140, 142, 144, and 146 are also referred to herein as "water outlets" and "washing fluid outlets." The water outlets are spaced in a manner required to function in combination with the dishwasher flow controller described hereinbelow to selectively supply water to the washing fluid conduit system. Further, a drain outlet 147 is provided in the sump to facilitate draining of used washing fluid of the dishwasher to a sump region 151 containing the water to be recirculated bt means of the pump 116.

Figure 3:
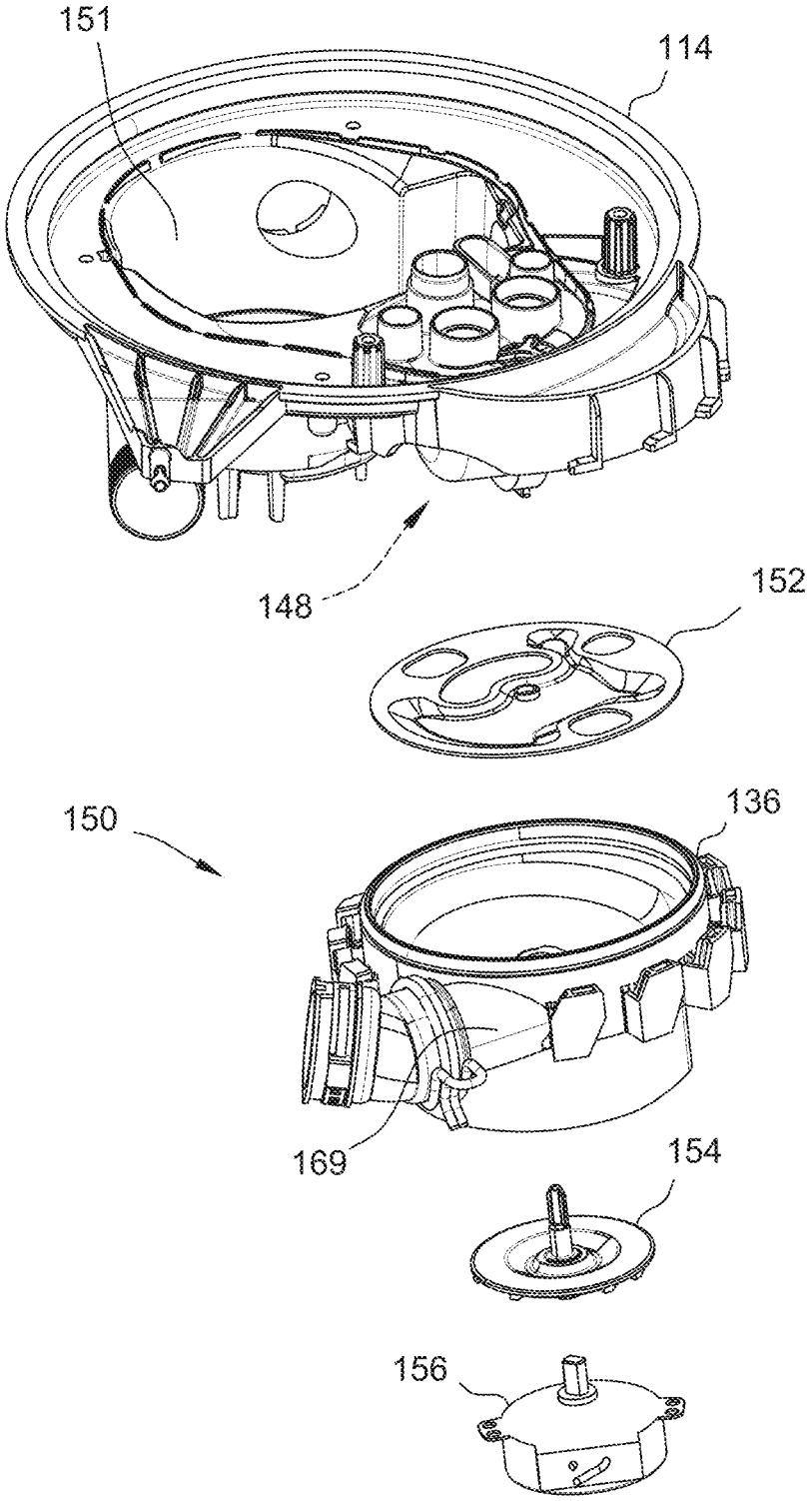
FIG. 3 is an expanded view of the sump and a flow controller assembly of the dishwasher device of FIG. 1.

Washing fluid that flows from the sump through first outlet 138 supplies washing fluid to a first spray arm of the washing fluid conduit system 118. Washing fluid that flows from the sump through second outlet 140 provides washing fluid to a second spray arm of the washing fluid conduit system, and washing fluid that flows from the sump through third outlet 142 provides washing fluid to a third spray arm of the washing fluid conduit system. In the exemplary embodiment, the first spray arm is middle spray arm 122, the second spray arm is top spray arm 120, and the third spray arm is lower spray arm 124. Therefore, in the exemplary embodiments, first outlet 138 provides washing fluid from sump 114 to middle spray arm 122, second outlet 140 provides washing fluid from sump 114 to top spray arm 120, and third outlet 142 provides washing fluid from sump 114 to lower spray arm 124. In other embodiments, outlets 138, 140, 142 may enable the supply of washing fluid from sump 114 to any of spray arms 120, 122, 124 and/or any other component of washing fluid conduit system 118 of dishwasher 100. As shown in FIG. 3, sump 114 is unitary and comprised of a single-piece construction.

First extra outlet 144 and second extra outlet 146 may enable washing fluid to be supplied from sump 114 to a variety of components of dishwasher 100. For example, first extra outlet 144 may provide washing fluid from sump 114 to a component of dishwasher 100 outside of dishwashing chamber 103 of tub 106, as will be described in greater detail below. Alternatively, first extra outlet 144 and/or second extra outlet 146 may provide washing fluid from sump 114 to, for example any of: a detergent dispenser (e.g., included within the door 112 of the dishwasher 100, shown in FIG. 1) for diluting the detergent before dispensing into the chamber 103, a filter of sump 114 that filters washing fluid from the washing fluid conduit system 118 such that the filter is "self-cleaning" (e.g., such that the contents of the filter are automatically drained appropriately, and the filter does not have to be cleaned manually by a user of the dishwasher), an extra tank spaced from sump 114 and arranged out side the sump (e.g., to hold fresh water/washing fluid and/or cleaned and filtered washing fluid/water to be used at a later time during a dishwashing cycle), a heat exchanger for exchanging warm water/washing fluid with fresh water/washing fluid for rinsing dishes within the dishwasher or heat exchanger for exchanging refrigerant fluid of a heat pump system with water, a specific rotating/fixed washing fluid spray device configured to spray washing fluid in a specific direction according to user preferences, and any other suitable component of the dishwasher. It should be understood from the present disclosure that first extra outlet 144 and second extra outlet 146 may provide washing fluid to one or more of the components of the dishwasher 100 listed above. Accordingly, first and second extra outlets 144 and 146 provide enhanced functionality beyond providing washing fluid from sump 114 to the washing fluid conduit system 118.

FIG. 3 illustrates an exploded view of sump 114 (shown in FIG. 1) and a flow controller assembly 150. Sump 114 includes a disk portion 148 (shown in FIG. 5) formed within external side 134 of the sump. Flow controller assembly 150 includes disk 152, CAM disk 154, switch (not specifically shown), and motor 156. Disk portion 148 of sump is sized and shaped to receive disk 152. CAM disk 154, switch, and motor 156 are configured to rotate disk 152 relative to sump outlets 138, 140, 142, 144, and 146. The relative movement between the disk and sump outlets will be described in further detail herein. However, generally, in the exemplary embodiment, controller may signal to the switch and motor 156 to rotate CAM disk 154 at the intervals and times consistent with the dishwasher cycle and as a result, the disk 152 is suitably moved relative to the sump and outlets.

In the exemplary embodiment, housing 136 fits around or envelops the disk 152 when the disk 152 is positioned within disk portion 148 of sump 114. In use, the disk is located between the housing and sump. CAM disk 154, switch, and motor 156 are located within an internal compartment (not specifically shown) of the housing 136 such that at least the CAM disk is in contact with the disk 152 through the housing 136. In other embodiments, the housing, the CAM disk, the switch, and the motor may have a different configuration. For example, the CAM disk, switch, and motor may be immediately adjacent disk 152 rather than separated by a portion of the housing body as presently disclosed. that the housing 136 is below the CAM disk 154, the switch, and the motor 156.

Figure 4A:
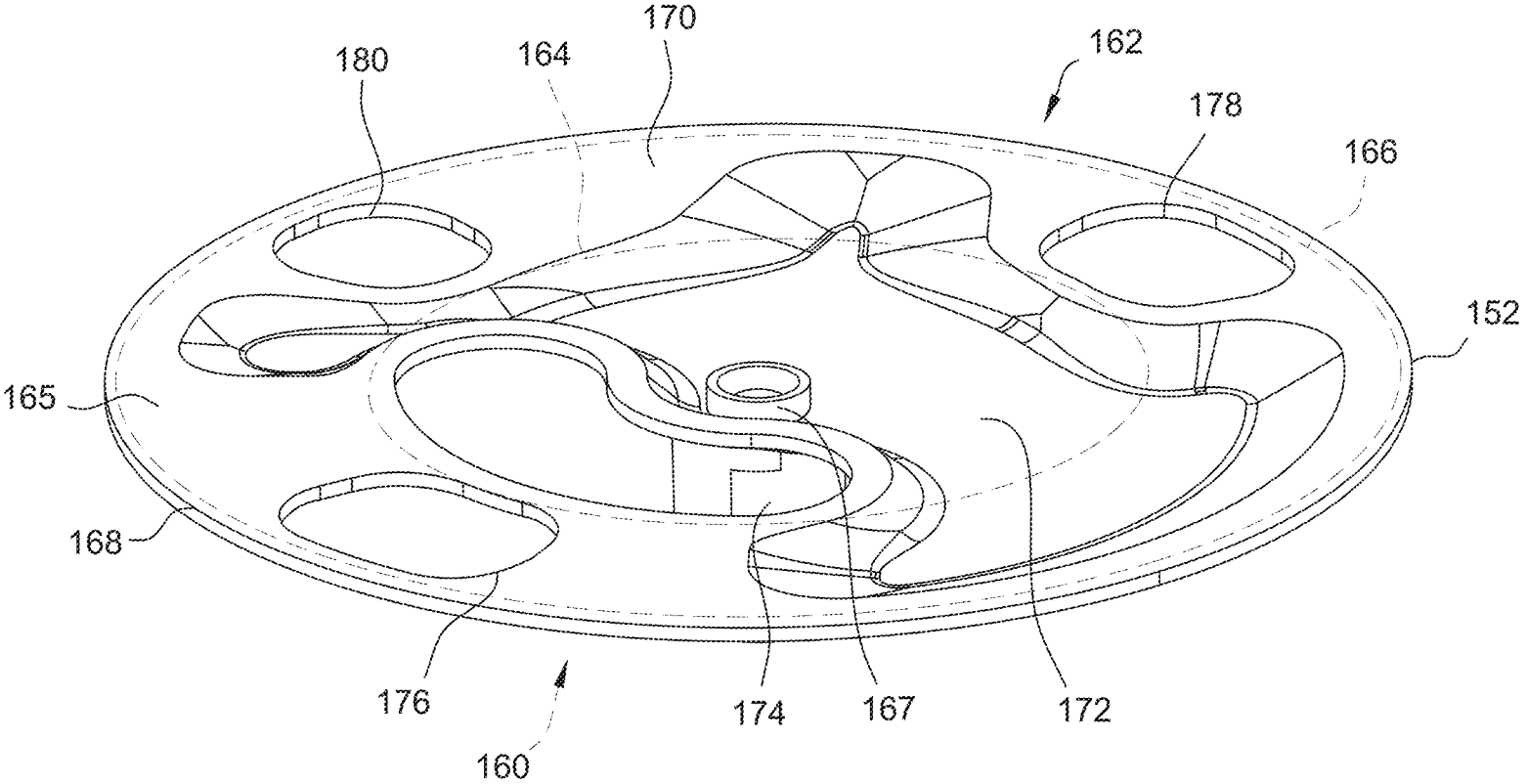
FIG. 4A is a perspective view of one embodiment of a disk of the flow controller assembly of FIG. 3.

FIG. 4A illustrates one embodiment of disk 152 of flow controller assembly 150. Disk 152 has first side 160 and second side 162, the second side 162 being in contact sump 114 when disk 152 is positioned in disk portion 148 of sump 114. Disk 152 includes first region 164, second region 166, center region 167, and periphery 168. First and second regions 164, 166 are separated by a radial distance and are substantially concentric circular regions. The first region is adjacent the center region of the disk, and second region is the annular area adjacent the first region. First region 164 is located proximate the center region, radially inward from the disk periphery. The second region is located proximate the periphery 168. Central region 167 is adapted to receive a shaft of the CAM disk 152 to move the disk sequentially, as required during dishwasher operation, the CAM disk 152 being in turn connected to the drive shaft of the motor 156. Disk 152 further includes a raised, continuous surface 170 that extends inwardly from periphery 168. Raised, continuous surface 170 is planar. Moving along the disk periphery, disk surface 170 extends radially inwardly at varying radial distances relative to the periphery. As shown in FIG. 4A, inner surface 172 limits the radially inward extent of continuous surface 170. Inner surface 172 is concave and terminates at continuous edge 165. That is, the inner surface 172 slopes inward toward a center of the disk 152 from the raised, continuous surface 170. Continuous edge 165 extends at variable outward extending radially distances relative to center region 167 of disk 152 along inner surface edge 165. In summary, along its length, continuous edge 165 has a varying radial dimension relative to center region 167. Notably, disk 152 is substantially planar except for the concave inner portion. As shown in FIG. 4A, the disk 152 includes a plurality of apertures provided in the raised continuous surface. In the exemplary embodiment, the disk 152 includes first aperture 174, second aperture 176, third aperture 178, and fourth aperture 180 formed within the raised, continuous surface 170 of disk 152.

In the exemplary embodiment, first aperture 174 is formed in first region 164 of disk 152, and second, third, and fourth apertures 176, 178, and 180 respectively are formed in second region 166 of disk 152. In the exemplary embodiment, first aperture 174 has an oblong shape. In other embodiments, first aperture 174 may have any suitable shape to align with outlets 138, 140, 142, 144, and/or 146 (shown in FIG. 2) of sump 114, as described further herein. In some embodiments, for example, first aperture 174 may be two separate apertures that together form an oblong-type shape. In the exemplary embodiment, second, third, and fourth apertures 176, 178, and 180 have generally similar shapes that are squared-shaped with curved edges. Fourth aperture 180 is separated from the third and second apertures 176 and 178 by approximately the same angular distance. The second and third apertures are separated by a distance that is greater than the angular distance that separates the fourth, second and third apertures. In other embodiments, second, third, and fourth apertures 176, 178, and 180 may have any suitable shape to align with outlets 138, 140, 142, 144, and/or 146 of sump 114, as described further herein. For example, the second, third, and fourth apertures may have circular and/or oval shapes.

Figure 4B:
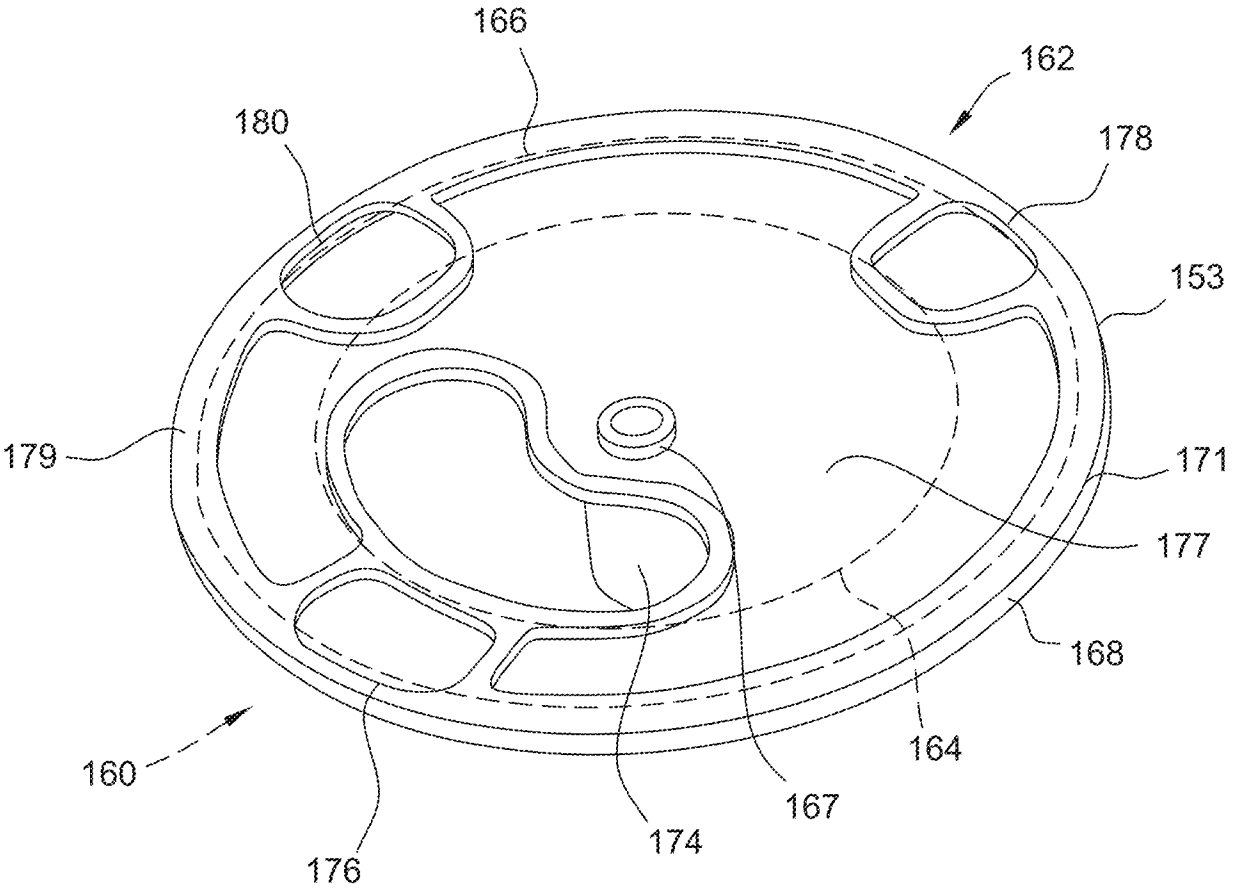
FIG. 4B is a perspective view of another embodiment of a disk of the flow controller assembly of FIG. 3.

FIG. 4B illustrates a second embodiment disk 153 of flow controller assembly 150. Disk 153 is substantially similar to disk 152. Like disk 152, disk 153 has external side 160, internal side 162, first region 164, second region 166, and outer periphery 168. Additionally, the first and second regions 164, 166 are radially spaced apart from one another. Further, the disk 153 includes first aperture 174, second aperture 176, third aperture 178, and fourth aperture 180. Disk 153 includes a raised, continuous surface 171 that extends radially inwardly from the full periphery 168 and extends along the perimeters of each of the apertures 174, 176, 178, and 180 of disk 153. Surface 171 has planar surface area that is less than the surface area of surface 170. Concave inner portion 177 is defined by edge 179, that has varying radial distances from center region 167 of disk 153. Both the external side 160 and the internal side 162 of the disk 153 have planar surfaces, and the whole disk 153 has a concave shape.

Figure 5A:
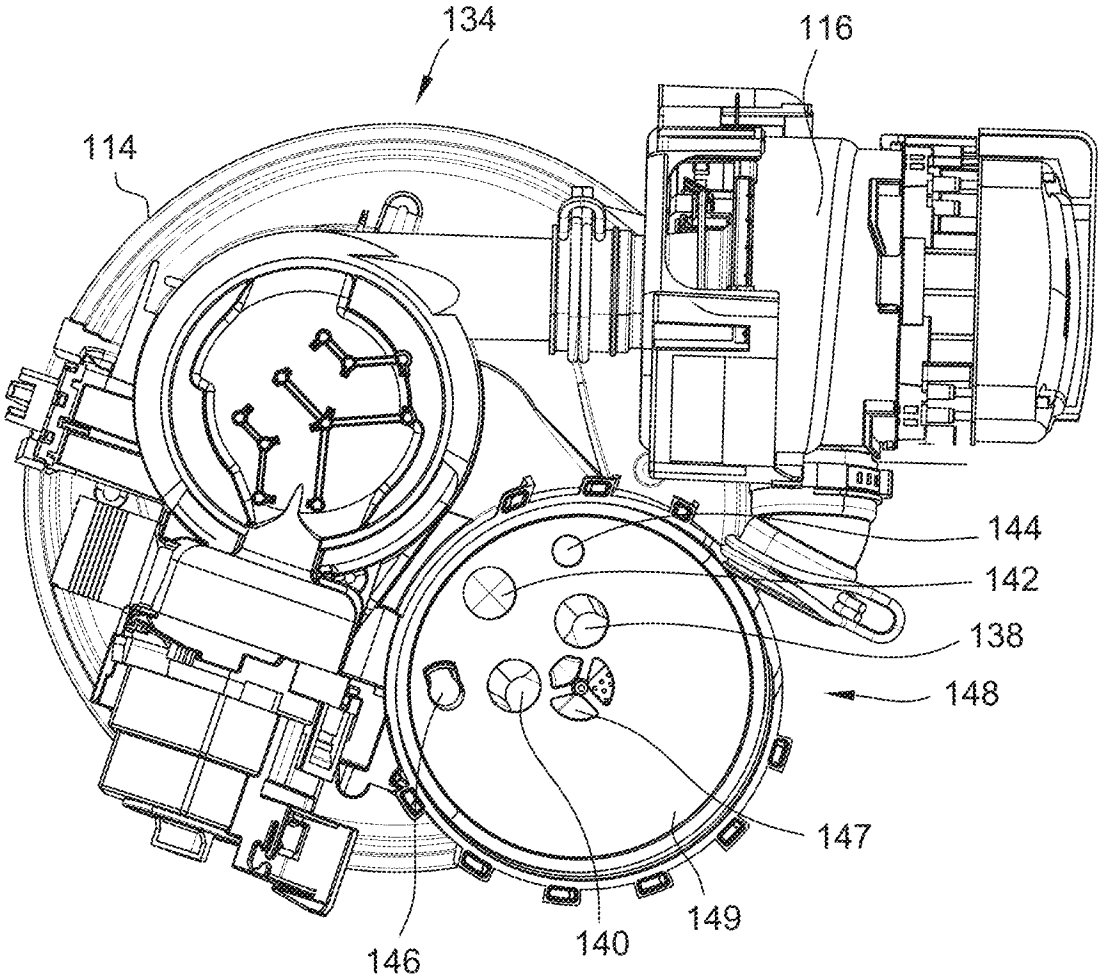
FIG. 5A is a bottom perspective view of the sump of FIG. 3.
Figure 5B:
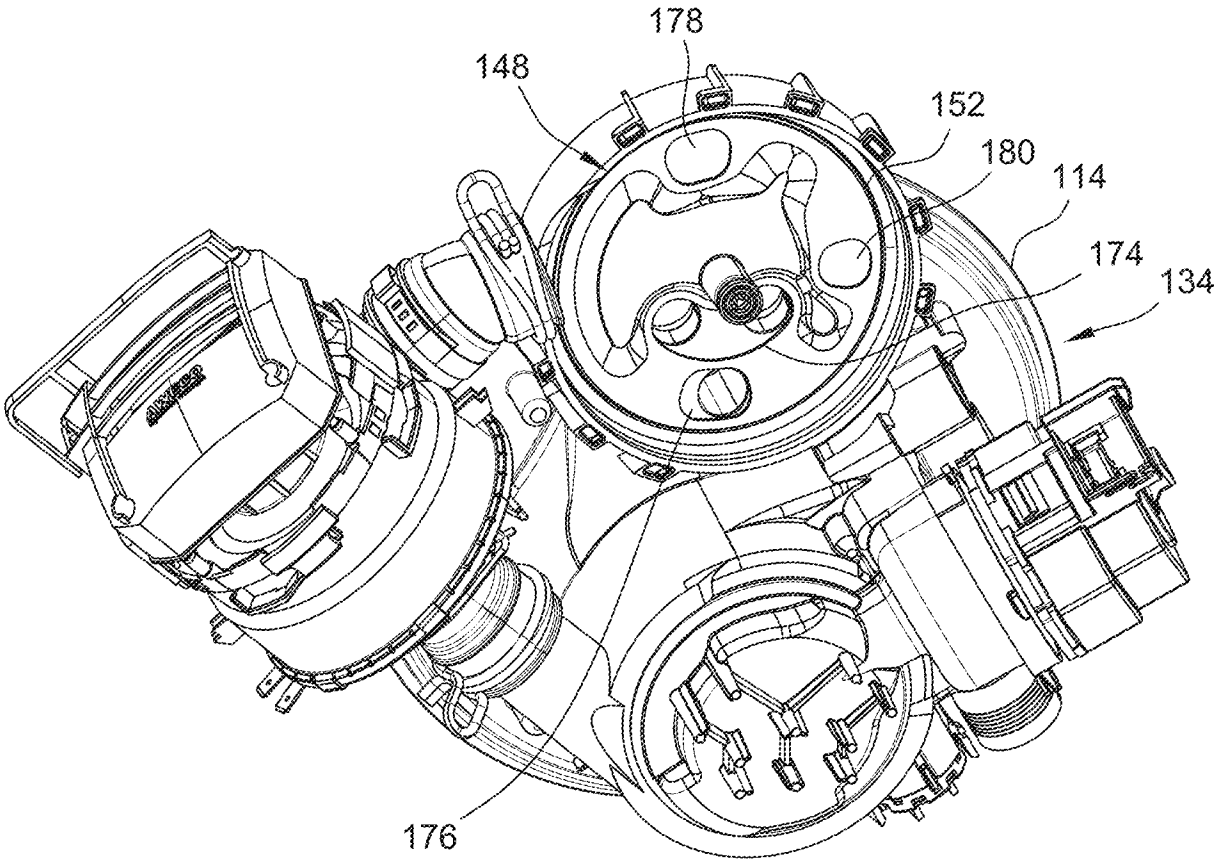
FIG. 5B is a bottom perspective view of the sump and flow controller assembly of FIG. 3.

FIG. 5A illustrates a bottom perspective view showing external side 134 of sump 114 and disk portion 148 of sump 114 of dishwasher 100; and FIG. 5B illustrates the bottom perspective view with disk 152 within the disk portion. Disk 153 would be oriented and located within disk portion 148 in the same manner disclosed herein. Disk portion 148 includes a flat surface 149 and drain outlets 147. The drain outlets 147 allow used washing fluid to drain from the washing fluid conduit system 118 to the sump, as described further herein. Disk portion 148 is sized and shaped such that disk 152 fits within disk portion 148. That is, when the disk 152 is located in disk portion 148 of the sump the washing fluid from pump 116 urges disk 152 into engagement with sump 114. Raised, continuous surface 170 of disk 152 sealingly engages the flat surface of the disk portion to create a water-tight seal between sump 114 and disk 152. Surface 171 of disk 153 sealingly engages the disk portion to create the same sump-disk water tight seal. A ring gasket 190 (shown in FIG. 6) is provided between the disk portion 148 and the housing 136 to produce a tight fit between the flow controller and sump. Disks 152 and 153 function substantially the same and have similar structure, with the differences between the disks comprising the extent of surfaces 170 and 171 and inner portions 172 and 177. As the description proceeds, for simplicity, operation of disk 152 will be described.

When one or more of apertures 174, 176, 178, and/or 180 of disk 152 align with sump outlets 138, 140, 142, 144, and/or 146, outlets 138, 140, 142, 144, and/or 146 are considered "open" and washing fluid is able to flow through the outlets. Conversely, outlets 138, 140, 142, 144, and/or 146 are considered "closed" and washing fluid is prevented from flowing through the water outlets when none of the apertures are aligned with the outlets. Notably, the closed outlets are not completely blocked, as used washing fluid drains through the closed outlets and the drain outlets 147 through a cavity of the disk, as described in additional detail below. The raised, continuous surface 170 of the disk 152 ensures that there is not leakage of washing fluid between the open and closed outlets 138, 140, 142, 144, and 146.

Figure 6:
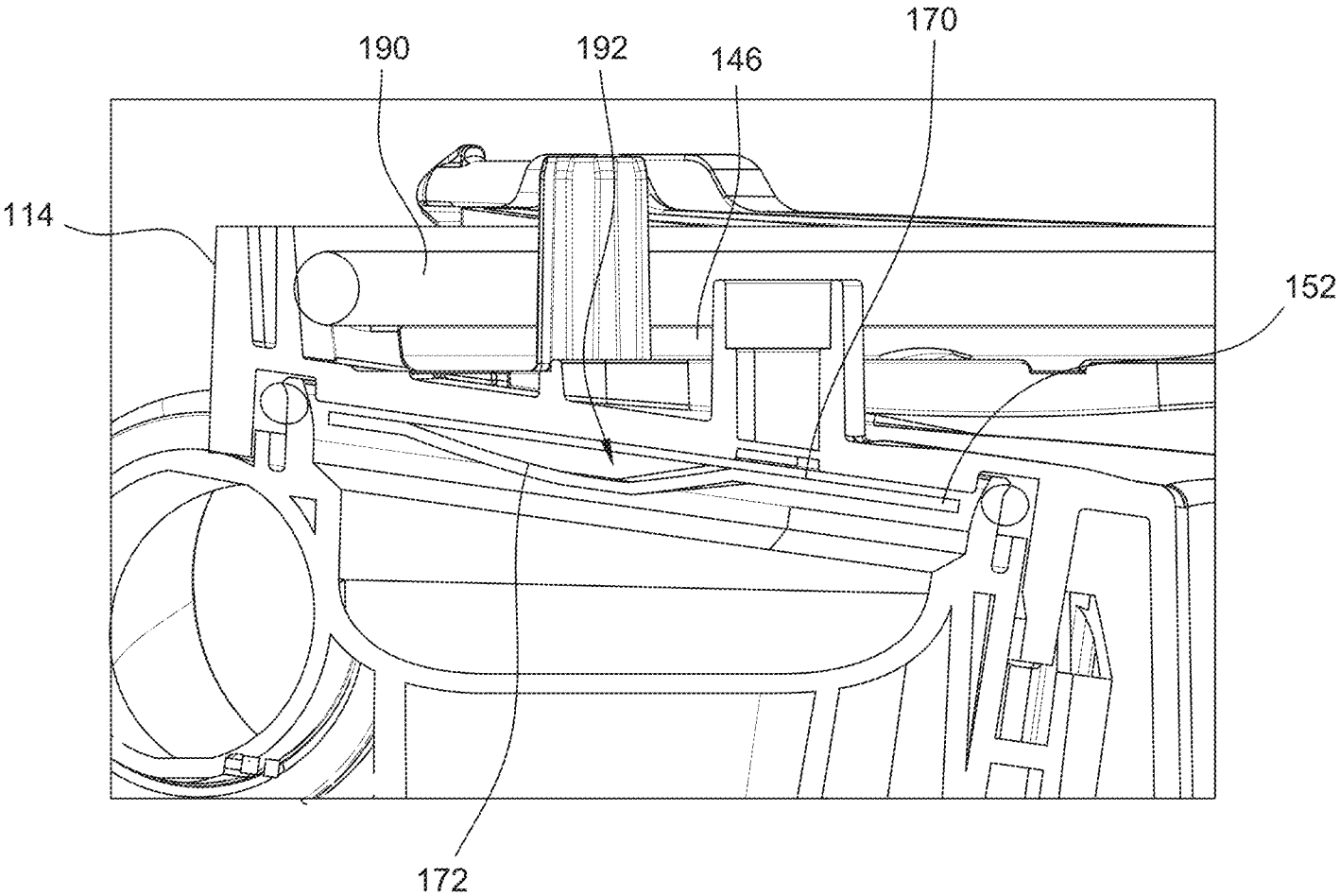
FIG. 6 is an axial cross-sectional view of the sump and flow controller assembly of FIG. 3.

FIG. 6 illustrates a cross-sectional view of the dishwasher sump and disk 152. In the illustrated embodiment, one aperture 174, 176, 178, or 180 of disk 152 is aligned with second extra outlet 146 of the sump. That is, an aperture 174, 176, 178, or 180 formed within the raised, continuous surface 170 is aligned with second extra outlet 146, so that second extra outlet 146 is open and washing fluid from the sump is supplied to the second extra outlet and flows to another component of the dishwasher, like, for example, to a filter or a detergent booster of the dishwasher. Inner surface 172 of disk 152 defines cavity 192 between the flat surface 149 of the disk portion 148 and disk 152. The closed outlets 138, 140, 142, 144, and/or 146 (in the illustrated embodiment, outlets 138, 140, 142, and 144) are in fluid communication with the cavity 192. Cavity 192 is in fluid communication with a separate portion 151 of the sump for example a portion that holds washing fluid for use by the dishwasher.

When one or more components of water conduit system 118 (shown in FIG. 1) are in use, used washing fluid from the water conduit system must drain to the sump to be filtered and recycled for use in the same dishwashing cycle of the dishwasher. While the open outlets supply washing fluid to one or more components of the dishwasher and/or water conduit system 118, the closed outlets drain used washing fluid and return the used washing fluid back to the sump. Specifically, instead of having the washing fluid flow through the closed outlets, the closed outlets can drain used washing fluid because the closed outlets are in fluid communication with cavity 192 of the disk. The used washing fluid passes through the closed outlets 138, 140, 142, 144, and/or 146 to the cavity to be drained into the sump region 151 containing water to be recirculated. The water flow through the drain outlets 147 from the cavity 192 to the sump region 151.

FIGS. 7A-H illustrate potential operating positions of disk 152 and associated apertures 174, 176, 178, and 180 relative to outlets 138, 140, 142, 144, and/or 146 of sump 114. Disk 152 may be rotated into the illustrated operating positions by CAM disk 154, motor and switch 156, as required by dishwasher cycle controller. It should be noted that FIGS. 7A-H illustrate potential positions of disk 152 relative to sump 114 and are not a sequential ordering of the positions of the disk relative to the sump. Rather, disk 152 may be positioned in one or more of the positions shown in FIGS. 7A-H in a dishwashing cycle, as described in further detail below. The operating positions described herein also relate to operating positions of disk 153.

Further, in FIGS. 7A-H, only outlets 138, 140, 142, 144, and/or 146 of sump 114 with which one or more of the apertures 174, 176, 178, and/or 180 align are referenced for ease of illustration. For each position, the open outlets 138, 140, 142, 144, and/or 146 in alignment with a respective aperture 174, 176, 178, and/or 180 are identified by a washing fluid reference "W" in each of FIGS. 7A-H. The different positions of disk 152 allow sump 114 and pump 116 to selectively supply washing fluid to different dishwasher components and interior locations of chamber 103 depending on the open aperture/outlet combinations.

FIG. 7A illustrates the disk 152 in a potential position 202, called "Position A" herein. In Position A, first aperture 174 of disk 152 is aligned with both sump first outlet 138 and second outlet 140, and the second aperture 176 is aligned with third outlet 142. Accordingly, first, second, and third outlets 138, 140, and 142 are open, and the first and second extra outlets 144, 146 are closed. The open status of each of outlets 138, 140 and 142 is identified by a W as shown in FIG. 7A. In Position A, washing fluid from the sump is supplied to top spray arm 120 of the dishwasher through the open second outlet 140, middle spray arm 122 is supplied washing fluid from open first outlet 138, and lower spray arm 124 is supplied washing fluid from open third outlet 142. Through the first disk position washing fluid is supplied to top, middle, and lower spray arms 118, 120, and 122 concurrently and may be used to enable an "express" or "quick wash" dishwashing cycle.

FIG. 7B illustrates disk 152 in a potential position 204 relative to the sump outlets, called "Position B" herein. In Position B, first aperture 174 of disk 152 is aligned with second sump outlet 140. Accordingly, the second outlet 140 is open, and the first and third outlets 138, 142 and the first and second extra outlets 144 and 146 are closed. Open outlet 140 is identified by a W in FIG. 7B. As a result, in Position B, washing fluid from the sump is supplied to top spray arm 120 through open second outlet 140.

FIG. 7C illustrates disk 152 in a potential position 206 relative to the sump outlets, called "Position C" herein. In Position C, first aperture 174 of disk 152 is aligned with the second sump outlet 140, and fourth aperture 180 of disk 152 is aligned with third sump outlet 142. In Position C, second and third outlets 140, 142 are open, and first outlet 138, first extra outlet 144 and second extra outlet 146 are closed. As a result, washing fluid from sump 114 is supplied to top spray arm 120 through second outlet 140, and washing fluid is supplied to lower spray arm 124 through third outlet 142.

FIG. 7D illustrates disk 152 in a potential position 208 relative to the sump outlets, called "Position D" herein. In Position D, third aperture 178 of disk 152 is aligned with first extra outlet 144 of sump 114. As shown in FIG. 7D the open status of first extra outlet is reflected by a W. As a result, in Position D, first extra outlet 144 is open, and first, second and third outlets 138, 140, and 142 and second extra outlet 146 are closed. In Position D, washing fluid from the sump is supplied to an extra component of dishwasher 100 and/or water conduit system 118 through the first extra outlet 144.

FIG. 7E illustrates disk 152 in a potential position 210 relative to the sump outlets, called "Position E" herein. In Position E, third aperture 178 of disk 152 is aligned with the third sump outlet 142. As shown in FIG. 7E, the open status of the third sump outlet is reflected by a W. As a result, in Position E, third outlet 142 is open, and first and second outlets 138, 140 and first and second extra outlets 144, 146 are closed. As a result, when the disk is in Position E, washing fluid from sump 114 is supplied to lower spray arm 124 through third outlet 142.

FIG. 7F illustrates disk 152 in a potential position 212 relative to the sump outlets, called "Position F" herein. In Position F, third aperture 178 of disk 152 is aligned with second extra outlet 146. As shown in FIG. 7E, the open status of the second extra outlet is reflected by a W. As a result, in Position F, second extra outlet 146 is open, and first, second, and third outlets 138, 140, and 142 and first extra outlet 144 are closed. As a result, in Position F, washing fluid from the sump is supplied to an extra component of dishwasher 100 and/or water conduit system 118 through the second extra outlet. The extra component may be, for example, a washing detergent booster apparatus, a sump filter, and any one of spray arms 120, 122, and/or 124 for an enhanced washing cycles, among other components described herein.

Figure 7H:
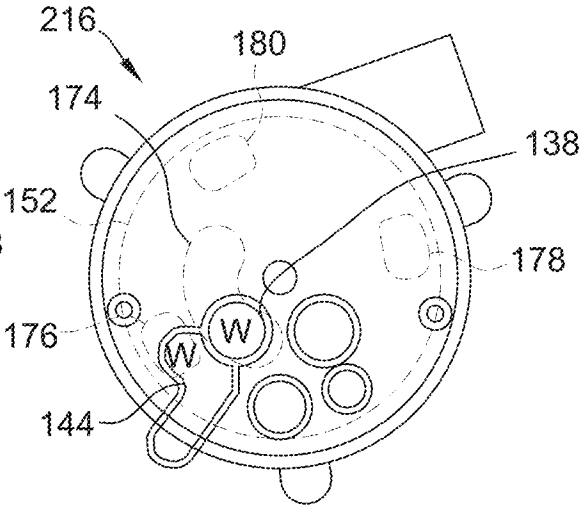
Figure 7G:
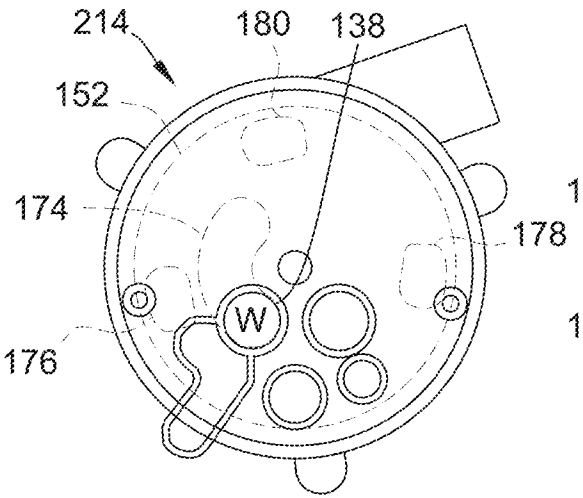

FIG. 7G illustrates disk 152 in a potential position 214 relative to the sump outlets, called "Position G" herein. In Position G, first aperture 174 of disk 152 is aligned with first sump outlet 138. As shown in FIG. 7G, the open status of the first sump outlet is reflected by a W. As a result, in Position G, first outlet 138 is open, and second and third outlets 140, 142 and first and second extra outlets 144, 146 are closed. As a result, in Position G, washing fluid from the sump is supplied to middle spray arm 122 through first outlet 138.

FIG. 7H illustrates disk 152 in a potential position 216 relative to the sump outlets, called "Position H" herein. In Position H, first aperture 174 of disk 152 is aligned with first sump outlet 138, and second aperture 176 of disk 152 is aligned with first extra sump outlet 144. Open status of outlet 138 and first extra outlet 144 are each identified by a W in FIG. 7H. As a result, first outlet 138 and first extra outlet 144 are open, and second and third outlets 140, 142 and second extra outlet 146 are closed. Therefore, in Position H, washing fluid from the sump is supplied to middle spray arm 122 via first outlet 138, and an extra component of the dishwasher 100 and/or water conduit system 118 is supplied with washing fluid flowed from the first extra outlet 144.

In one embodiment, for example, a first dishwashing cycle of dishwasher 100 may comprise disk 152 being rotated among Position A. Position C, and Position G and then to at least one of Position D and Position F. The first dishwashing cycle may be an "express" or "turbo" dishwashing cycle since, in Position A, water is supplied to each of the spray arms of the dishwasher for a faster and more efficient dishwashing cycle. In another embodiment, for example, a second dishwashing cycle of dishwasher 100 may comprise disk 152 being rotated among Position B. Position E, Position G, and at least one of Position D and Position F. The second dishwashing cycle may be a deep clean or long cycle since, in the second dishwashing cycle, each of the spray arms are supplied washing fluid at different times. It should be understood that disk 152, 153 may be moved through any combination of positions by programmed controller to complete the dishwashing cycles selected by the dishwasher user.

Figure 8A:
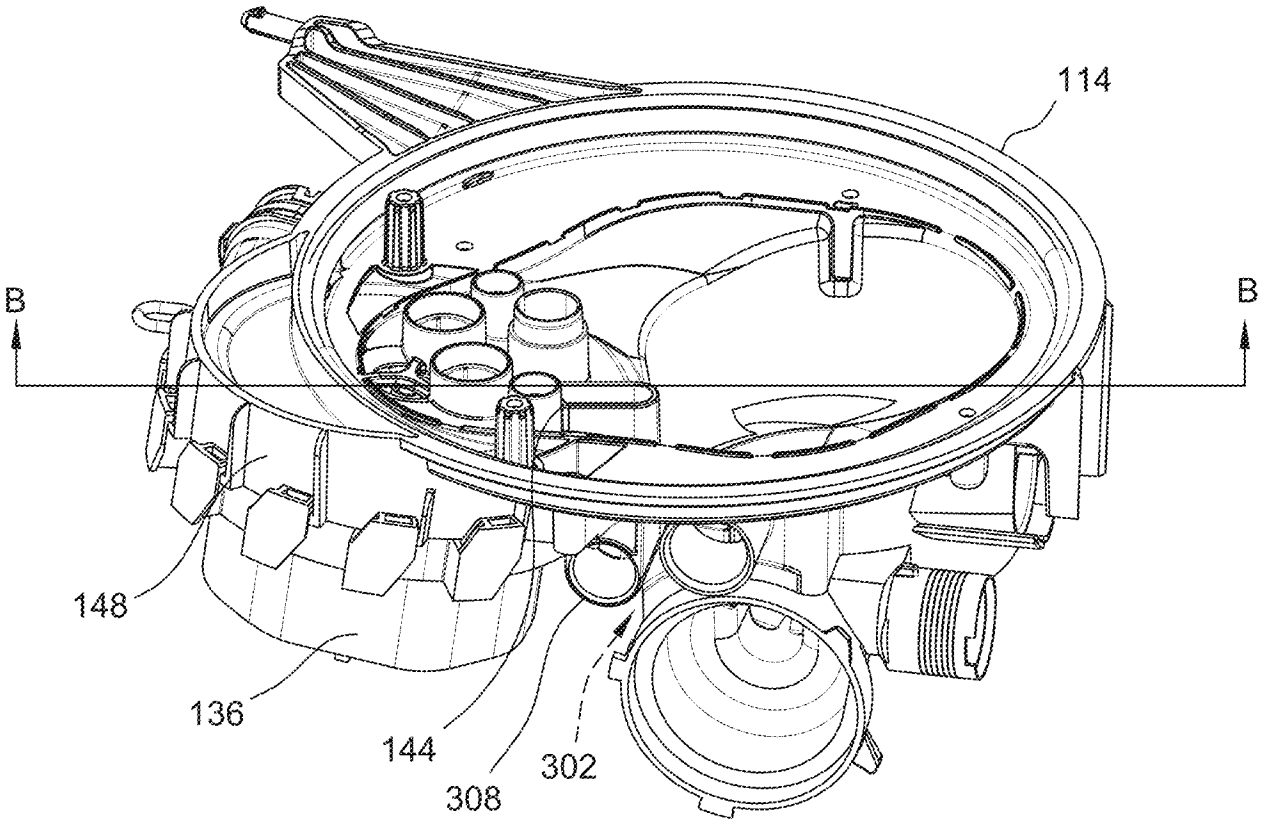
FIG. 8A is a perspective view of the sump of FIG. 3.
Figure 8B:
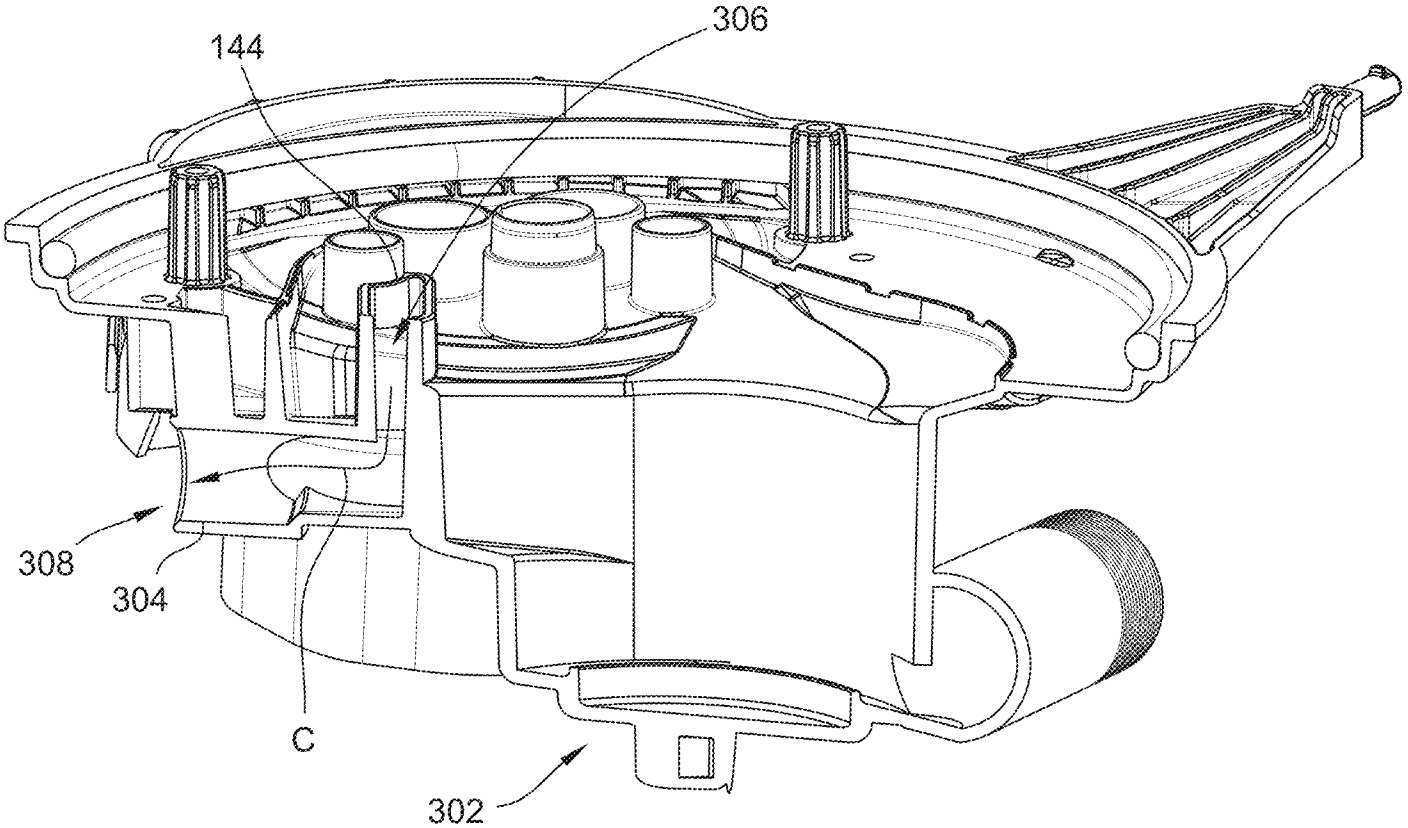
FIG. 8B is a cross-sectional view of the sump of FIG. 8A taken along section line B-B in FIG. 8A.

FIG. 8A illustrates a perspective view of sump 114 of dishwasher 100, and FIG. 8B illustrates a cross-sectional view of the sump taken along line B-B shown in FIG. 8A. FIG. 8B shows a cross-section of first extra outlet 144 and interior 302 of the sump.

FIG. 8B shows interior 302 of the sump. The sump interior 302 includes channel 304 formed within the sump. Channel 304 extends between first end 306 and second end 308. In use, the first end is located proximate first extra outlet 144, and second end 308 is located proximate a separate component (not specifically shown) of the dishwasher 100. For example, the extra component may be a tank of washing fluid separate from the sump 114 and the pump 116 (shown in FIG. 1). A conduit, not shown would flow connect outlet 308 and the separate component.

When the first extra outlet 144 of the sump 114 is open in previously described D and H, washing fluid from sump 114 is supplied to the extra component of the dishwasher through channel 304. The washing fluid moves from the first end 306 of the channel 304 to second end 308 of channel 304, as depicted by the arrow C in FIG. 8B, so that the washing fluid is driven outside the sump 114

Figure 9:
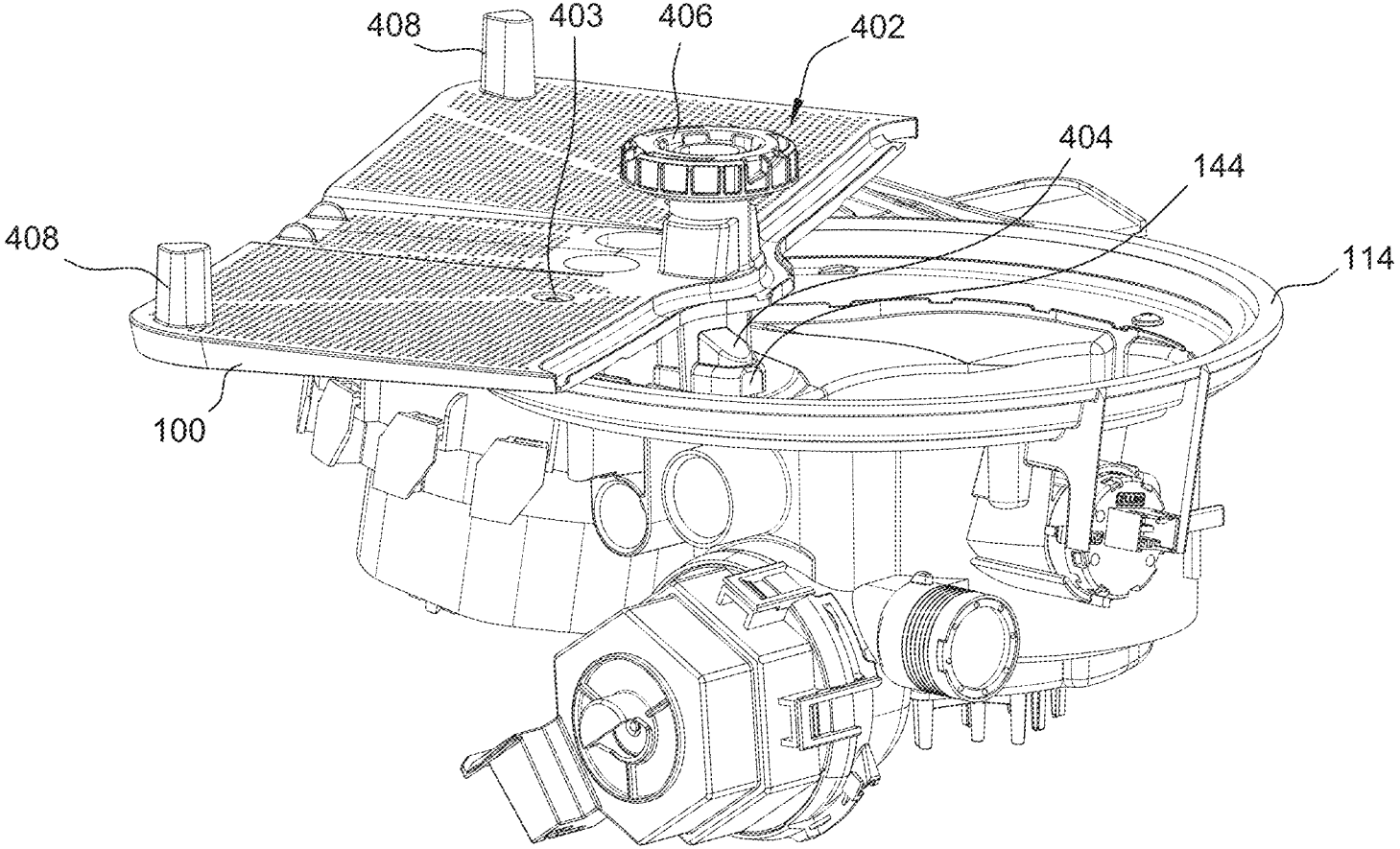
FIG. 9 is a perspective view of a portion of a sump, pump, and bottom panel of the dishwasher device of FIG. 1.

FIG. 9 illustrates a perspective view of sump 114 and a portion of bottom panel 108 of dishwasher 100 (shown in FIG. 1). The dishwasher includes filtration assembly 402, also referred to herein as a "filter" that is connected to the sump with a fixation element 403. The filtration assembly acts as a filter for the washing fluid returning to the sump after the washing fluid has been deployed in chamber 103 via water conduit system 118. Filtration assembly 402 includes cap 404 attached to the first extra outlet 144 with a connection element (not specifically shown), preferably the cap 404 simply fits the profile of the first extra outlet 144 by interlocking. Cap 404 forms part of the pathway for the washing fluid supplied to the extra component of dishwasher 100 through first extra outlet 144, as described with respect to FIG. 8B. That is, the cap attaches to first extra outlet 144 such that the washing fluid supplied to the first extra outlet from the dishwasher chamber and sump follows the path of arrow C (shown in FIG. 8B). The fixation element 403 and the connection element may include, for example, a tab, an interlocking element, or any suitable element that fixes the filtration assembly to the sump and sealingly connects cap 404 with first extra outlet 144, in a specific embodiment the fixation element 403 screws.

In one embodiment, top 406, also referred to herein as a "hub," of filtration assembly 402 connects the filtration assembly and at least one of outlets 138, 140, 142, 144, and/or 146 to lower spray arm 124 of water conduit system 118 of the dishwasher. Filtration assembly 404 includes one or more aeration towers 408 for aerating washing fluid.

Figure 10:
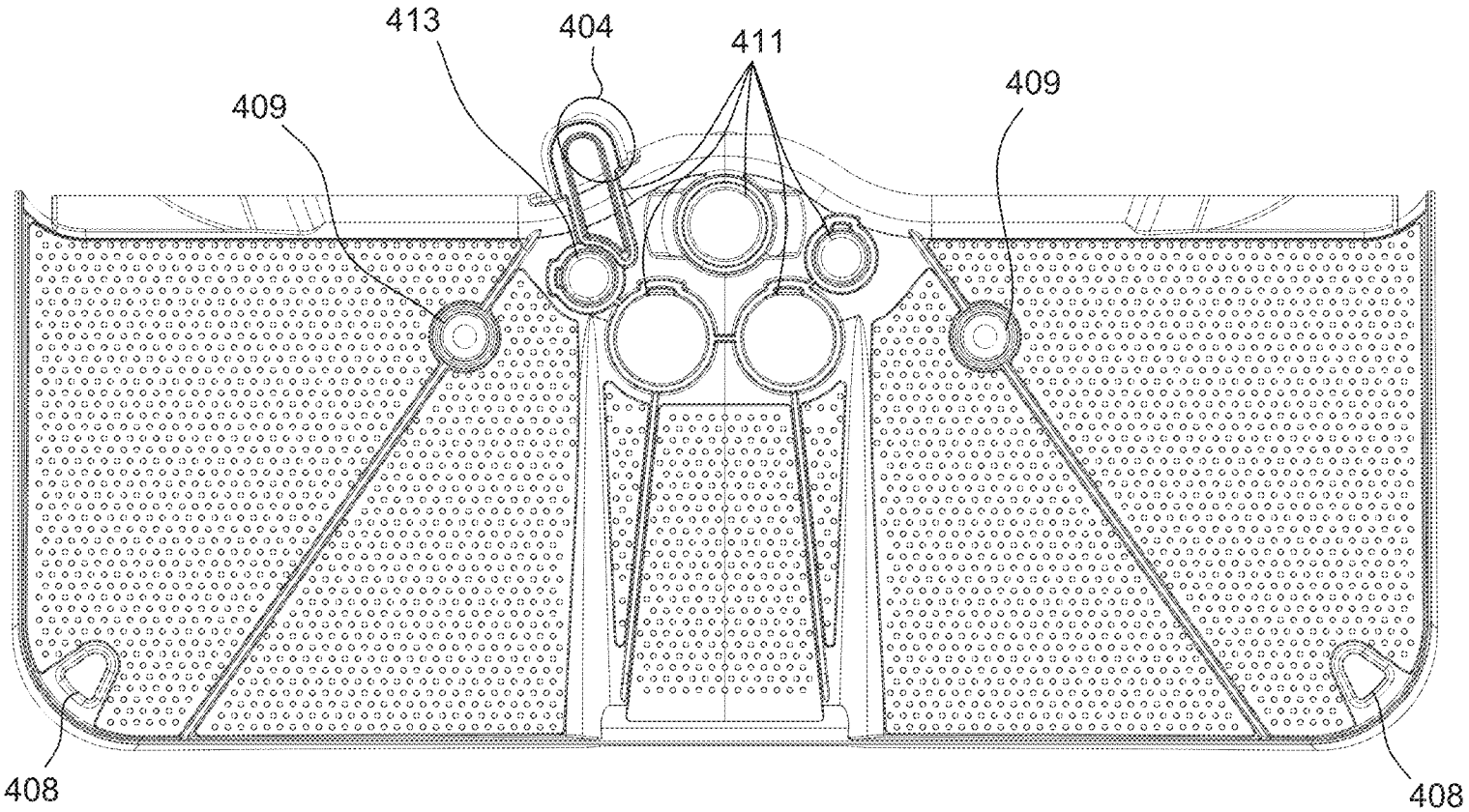
FIG. 10 is a bottom perspective view of the portion of the bottom panel of FIG. 9.

FIG. 10 illustrates a bottom perspective view of the portion of the bottom panel shown in FIG. 9. The bottom panel includes aeration towers 408, fixation element apertures 409, and sump attachments 411. Fixation element apertures 409 are sized and shaped to accept fixation elements 403 to connect the filtration assembly to the sump. Sump attachments 411 are sized and shaped to fit over the respective outlets of the sump to connect the outlets to the respective spray arms of the water conduit system and/or different components of the dishwasher, as described herein. In the case of the sump attachment that attaches to the first extra outlet of the sump, the bottom panel includes a channel 413 that allows the washing fluid to move in the direction of arrow C (shown in FIG. 8B), as described herein.

An exemplary dishwasher has been described above. In use, washing fluid is supplied to one or more spray arms of a washing fluid conduit system via a washing fluid delivery system to wash dishes, stemware, plates, cups, mugs, and any other items included within the dishwasher. The washing fluid is supplied from a sump of the dishwasher, wherein a pump supplies the washing fluid to the sump. The sump includes three outlets that connect to each of the three spray arms of the washing fluid conduit system and two extra outlets that connect to different components of the dishwasher like, for example, a channel of the sump, a detergent booster of the dishwasher, an extra tank of the dishwasher, etc. A flow controller including a disk controls the supply of the washing fluid from the sump to the plurality of outlets, and therefore, to the spray arms and/or other components of the dishwasher. Specifically, the disk includes apertures, and the disk and its apertures rotate relative to the water outlets of the sump. When one or more apertures of the disk align with one or more of the water outlets, washing fluid flows from the sump, through the apertures and water outlets of the sump, and to the spray arms and/or other components of the dishwasher. The pressure from the washing fluid pushes the disk to sealingly connect with the sump and the plurality of water outlets such that washing fluid is supplied to the open water outlets, and closed water outlets are in fluid connection with a cavity of the disk. Used washing fluid is drained from a cavity of the dishwasher through the closed water outlets via the cavity of the disk to return back to the sump.

The novel features of the dishwasher described herein allow washing fluid to be supplied to a washing fluid conduit system of the dishwasher in an efficient way such that different dishwashing cycles may be provided to a user of the dishwasher. The dishwashing cycles may include, for example, an express wash cycle and/or a deep clean cycle. Further, extra outlets of the sump allow washing fluid to also be supplied to other components of the dishwasher like, for example, an extra tank of the dishwasher, a detergent booster, a filter of the dishwasher, and any other suitable component.

Although specific features of various embodiments of the disclosure may be shown in some drawings and not in others, this is for convenience only. In accordance with the principles of the disclosure, any feature of a drawing may be referenced and/or claimed in combination with any feature of any other drawing.

This written description uses examples to disclose the exemplary dishwasher, including the best mode, and also to enable any person skilled in the art to practice the disclosure, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

The invention claimed is:

1. A dishwasher comprising:

a washing fluid conduit system comprising a first washing fluid supply conduit terminating at an outlet, a second washing fluid supply conduit terminating at an outlet, and a third washing fluid supply conduit terminating at an outlet;

a sump comprising a plate comprising:

(i) a first outlet for a first spray device of the washing fluid conduit system;

(ii) a second outlet for a second spray device of the washing fluid conduit system; and (iii) a third outlet for a third spray device of the washing fluid conduit system;

a pump for pumping washing fluid from the sump to the washing fluid conduit system; and a flow controller assembly for controlling washing fluid flow from the sump to the washing fluid conduit system, the flow controller assembly comprising:

a disk comprising at least (i) a first aperture, (ii) a second aperture, and (iii) a fourth aperture; and a positioning device configured to:

rotate the disk to align the first aperture of the disk with the first outlet and second outlet of the plate and the second aperture of the disk with the third outlet of the plate;

supply, through the first, second, and third outlets of the plate, a washing fluid to the first, second, and third spray devices;

rotate the disk to align the first aperture and the fourth aperture of the disk with the second and third outlets respectively of the plate;

supply, through the second and third outlets of the plate, the washing fluid to the second and third spray devices;

rotate the disk to align the first aperture of the disk with the first outlet of the plate, and supply, through the first outlet of the plate, the washing fluid to the first spray device.

2. The dishwasher of claim 1, wherein the positioning device is further configured to:

rotate the disk to align the first aperture of the disk with the second outlet of the plate; and supply, through the second outlet of the plate, the washing fluid to the second spray device.

3. The dishwasher of claim 1, wherein the disk comprises at least a third aperture, and wherein the positioning device is further configured to:

rotate the disk to align the third aperture of the disk with the third outlet of the plate; and supply, through the third outlet, the washing fluid to the third spray device.

4. The dishwasher of claim 1, wherein the sump further comprises at least a first extra outlet, and the disk comprises at least a third aperture, wherein the positioning device is further configured to:

rotate the disk to align the third aperture of the disk with the first extra outlet of the plate; and supply, through first extra outlet of the plate, the washing fluid to an additional device of the washing fluid conduit system.

5. The dishwasher of claim 4, wherein the plate further comprises a second extra outlet, and wherein the positioning device is further configured to:

rotate the disk to align the third aperture of the disk with the second extra outlet of the plate; and supply, through first extra outlet of the plate, the washing fluid to an additional device of the washing fluid conduit system.

6. The dishwasher of claim 1, wherein the plate comprises:

a periphery;

a first outlet region comprising (i) the first outlet for supplying washing fluid to the first washing fluid supply conduit and (ii) the second outlet for supplying washing fluid to the second washing fluid supply conduit; and a second outlet region comprising the third outlet for supplying washing fluid to the third washing fluid supply conduit, wherein the first and second outlet regions are arranged at different locations on the plate.

7. The dishwasher of claim 6, wherein the second outlet region comprises at least one extra outlet.

8. The dishwasher of claim 1, wherein the disk comprises:

a first annular region comprising the first aperture; and a second annular region comprising at least the second aperture and the fourth aperture, wherein the first and second annular regions are separated by a distance on the disk.

9. The dishwasher of claim 8, wherein the second annular region further comprises the third aperture.

10. The dishwasher of claim 6, wherein the plate is disk-shaped, wherein the second outlet region is located proximate the peripheral portion and the first outlet region is located a radial distance from the peripheral portion.

11. The dishwasher of claim 4, wherein the additional device of the washing fluid conduit system comprises at least one of (i) an extra spray device of the washing fluid conduit system, (ii) a detergent dispenser, (iii) a tank arranged outside of the sump, (iv) a filter to be automatically cleaned by the washing fluid, and (v) a heat exchanger of the washing fluid conduit system.

12. A dishwasher comprising:

a washing fluid conduit system comprising a plurality of washing fluid supply conduits terminating at an outlet;

a sump comprising a plate comprising:

(i) a first outlet for a first spray device of the washing fluid conduit system;

(ii) a second outlet for a second spray device of the washing fluid conduit system; and (iii) a third outlet for a third spray device of the washing fluid conduit system;

a pump for pumping washing fluid from the sump to the washing fluid conduit system; and a flow controller assembly for controlling washing fluid flow from the sump to the washing fluid conduit system, the flow controller assembly comprising:

a disk comprising at least (i) a first aperture, (ii) a second aperture, and (iii) a third aperture; and a positioning device configured to:

rotate the disk to align the first aperture of the disk with the first outlet and second outlet of the plate and the second aperture of the disk with the third outlet of the plate;

supply, through the first, second, and third outlets of the plate, a washing fluid to the first, second, and third spray devices;

rotate the disk to align the first aperture of the disk with the first outlet of the plate;

supply, through the first outlet of the plate, the washing fluid to the first spray device;

rotate the disk to align the first aperture of the disk with the second outlet of the plate;

supply, through the second outlet of the plate, the washing fluid to the second spray device;

rotate the disk to align the third aperture of the disk with the third outlet of the plate; and supply, through the third outlet, the washing fluid to the third spray device.

13. The dishwasher of claim 12, wherein the disk further comprises a fourth aperture and wherein the positioning device is further configured to:

rotate the disk to align the first aperture and the fourth aperture of the disk with the second and third outlets respectively of the plate;

supply, through the second and third outlets of the plate, the washing fluid to the second and third spray devices.

14. The dishwasher of claim 12, wherein the plate further comprises at least a first extra outlet, and wherein the positioning device is further configured to:

rotate the disk to align the third aperture of the disk with the first extra outlet of the plate; and supply, through first extra outlet of the plate, the washing fluid to an additional device of the washing fluid conduit system.

15. The dishwasher of claim 14, wherein the plate further comprises a second extra outlet, and wherein the positioning device is further configured to:

rotate the disk to align the third aperture of the disk with the second extra outlet of the plate; and supply, through first extra outlet of the plate, the washing fluid to an additional device of the washing fluid conduit system.

16. The dishwasher of claim 12, wherein the plurality of washing fluid supply conduits comprises a first washing fluid supply conduit, a second washing fluid supply conduit, and a third washing fluid supply conduit, and wherein the plate comprises:

a periphery;

a first outlet region comprising (i) the first outlet for supplying washing fluid to a first washing fluid supply conduit and (ii) the second outlet for supplying washing fluid to the second washing fluid supply conduit; and a second outlet region comprising (i) the third outlet or supplying washing fluid to the third washing fluid supply conduit, wherein the first and second outlet regions are arranged at different locations on the plate.

17. The dishwasher of claim 16, wherein the second outlet region comprises at least one extra outlet.

18. The dishwasher of claim 13, wherein the disk comprises:

a first annular region comprising the first aperture; and a second annular region comprising at least the second aperture and the third aperture, wherein the first and second annular regions are separated by a distance on the disk.

19. The dishwasher of claim 18, wherein the second annular region comprises the fourth aperture.

20. The dishwasher of claim 15, wherein the additional device of the washing fluid conduit system comprises at least one of (i) an extra spray device of the washing fluid conduit system, (ii) a detergent dispenser, (iii) a tank arranged outside of the sump, (iv) a filter to be automatically cleaned by the washing fluid, and (v) a heat exchanger of the washing fluid conduit system.

* * * * *